US011718885B2

(12) United States Patent
Zhu et al.

(10) Patent No.: US 11,718,885 B2
(45) Date of Patent: Aug. 8, 2023

(54) SLAG DISCHARGING METHOD IN PROCESS OF PRODUCING ULTRA-LOW PHOSPHORUS STEEL AND METHOD FOR PRODUCING ULTRA-LOW PHOSPHORUS STEEL

(71) Applicant: NANYANG HANYE SPECIAL STEEL CO., LTD, Henan (CN)

(72) Inventors: Shucheng Zhu, Nanyang (CN); Hu Zhao, Nanyang (CN); Shaopu Xu, Nanyang (CN); Zhongbo Li, Nanyang (CN); Hongyang Li, Nanyang (CN); Yang Yang, Nanyang (CN); Zhenglei Tang, Nanyang (CN); Tao Zhang, Nanyang (CN); Qingbo Liu, Nanyang (CN); Zhanjie Zhang, Nanyang (CN); Jiheng Yuan, Nanyang (CN); Sa Yu, Nanyang (CN); Wenju Kang, Nanyang (CN); Xi Chen, Nanyang (CN); Shuai Zhang, Nanyang (CN); Bo Li, Nanyang (CN); Zhiquan Du, Nanyang (CN); Di Zhao, Nanyang (CN); Liang Li, Nanyang (CN); Peng Jiang, Nanyang (CN); Yansheng Xue, Nanyang (CN); Keyi Fu, Nanyang (CN); Yingjie Wang, Nanyang (CN); Yongqi Yuan, Nanyang (CN); Zhenzhen Dong, Nanyang (CN); Baiming Pang, Nanyang (CN); Haiming Zheng, Nanyang (CN); Liang Chen, Nanyang (CN); Weibo Quan, Nanyang (CN); Xianxing Zhu, Nanyang (CN); Gaojian Yuan, Nanyang (CN); Chun Yang, Nanyang (CN); Yong Wang, Nanyang (CN); Yibo Bai, Nanyang (CN); Gazi Li, Nanyang (CN); Yuliang Lv, Nanyang (CN); Xibin Wang, Nanyang (CN); Yi Ren, Nanyang (CN)

(73) Assignee: NANYANG HANYE SPECIAL STEEL CO., LTD, Henan (CN)

( * ) Notice: Subject to any disclaimer, the term of this patent is extended or adjusted under 35 U.S.C. 154(b) by 488 days.

(21) Appl. No.: 16/635,174

(22) PCT Filed: May 23, 2019

(86) PCT No.: PCT/CN2019/088064

§ 371 (c)(1),
(2) Date: Jan. 30, 2020

(87) PCT Pub. No.: WO2020/113911

PCT Pub. Date: Jun. 11, 2020

(65) Prior Publication Data

US 2021/0214813 A1 Jul. 15, 2021

(30) Foreign Application Priority Data

Dec. 3, 2018 (CN) ..... 201811463555.4

(51) Int. Cl.

| | |
|---|---|
| ***C21C 7/00*** | (2006.01) |
| ***C21C 7/072*** | (2006.01) |
| ***C21C 7/064*** | (2006.01) |

(52) U.S. Cl.

CPC ..... *C21C 7/0087* (2013.01); *C21C 7/0025* (2013.01); *C21C 7/0075* (2013.01); *C21C 7/072* (2013.01); *C21C 7/0645* (2013.01)

(58) Field of Classification Search

CPC ... C21C 7/0087; C21C 7/0025; C21C 7/0075; C21C 7/072; C21C 7/0645; C21C 7/064; C21C 7/0043; C21C 7/06; C21C 5/5217; C21C 5/28; C21C 5/52

USPC ..... 75/528

See application file for complete search history.

(56) References Cited

U.S. PATENT DOCUMENTS 4,456,477 A * 6/1984 Masuda ..... C21C 5/35 75/544
4,473,397 A 9/1984 Bleeck et al.
4,564,388 A 1/1986 Vallomy

FOREIGN PATENT DOCUMENTS

CN 1584096 A 2/2005
CN 1212408 C * 7/2005

(Continued)

OTHER PUBLICATIONS

CN104131210A Translation (Year: 2014).*

(Continued)

*Primary Examiner* — Brian D Walck
*Assistant Examiner* — Danielle Carda
(74) *Attorney, Agent, or Firm* — Banner & Witcoff, Ltd.

(57) ABSTRACT

Disclosed is a slag discharging method in a process of producing ultra-low phosphorus steel, which relates to the technical field of iron and steel smelting, and in which molten steel is mixed with lime first to produce basic slag; then converting is performed with oxygen to increase the oxidizability of the basic slag; and a carbon-containing reducing agent is finally added, so that in the process that the carbon is oxidized to release a large amount of carbon monoxide gas, phosphates are captured, and the basic slag is rapidly foamed and overflows from the opening of the steel ladle, so that conditions are no longer available for rephosphorization. Also disclosed is a method for producing ultra-low phosphorus steel, which includes the above-described slag discharging method in a process of producing ultra-low phosphorus steel, and refining and ingotting after slag discharge.

18 Claims, No Drawings

(56) References Cited

FOREIGN PATENT DOCUMENTS

| | | | | | |
|---|---|---|---|---|---|
| CN | 1283827 | C | | 11/2006 | |
| CN | 101104876 | A | | 1/2008 | |
| CN | 101423879 | A | | 5/2009 | |
| CN | 103160647 | A | | 6/2013 | |
| CN | 104032095 | A | | 9/2014 | |
| CN | 104131210 | A | | 11/2014 | |
| CN | 104195290 | A | | 12/2014 | |
| CN | 107868900 | A | * | 4/2018 | ..... C21C 1/02 |
| CN | 108165705 | A | | 6/2018 | |
| CN | 109207672 | A | | 1/2019 | |
| DE | 3110569 | A1 | | 12/1982 | |
| DE | 3318332 | A1 | | 12/1983 | |
| EP | 3524707 | A1 | | 8/2019 | |
| JP | H0841521 | A | | 2/1996 | |
| JP | 2001064713 | A | | 3/2001 | |
| JP | 2015030868 | A | | 2/2015 | |
| JP | 2015218338 | A | | 12/2015 | |
| JP | WO2019116520 | A1 | | 12/2019 | |
| RU | 2001123 | C1 | | 10/1993 | |
| RU | 2055909 | C1 | | 3/1996 | |
| RU | 2007129747 | A | | 2/2009 | |
| SU | 406901 | A1 | | 11/1973 | |
| SU | 415313 | A1 | | 2/1974 | |
| SU | 1496637 | A3 | | 7/1989 | |
| UA | 122565 | C2 | | 12/2020 | |

OTHER PUBLICATIONS

CN1283827C Translation (Year: 2006).*
JP2001064713A Tranlation (Year: 2001).*
CN107868900A Translation (Year: 2018).*
Nayak, Soumya Kanta et al. Use of Calcium Carbide and Alumina based Slag Conditioner Briquettes in Steelmaking at JSPL, Angul, Feb. 2018 (Year: 2018).*
CN 1212408C Translation (Year: 2005).*
Dec. 20, 2019 (DE) Office Action—App 11 2019 000 054.3.
Jul. 5, 2021 (RU) Office Action—App 2020105196/05.
Jun. 5, 2019 (CN) Office Action—App 201811463555.4.
Aug. 12, 2019 (CN) Office Action—App 201811463555.4.
Sep. 12, 2019 (CN) Office Action—App 201811463555.4.
Jun. 20, 2019 (WO) Written Opinion of the ISA—App PCT/CN2019/088064.
Jun. 17, 2019 (WO) International Search Report—App PCT/CN2019/088064.
Aug. 31, 2021 (JP) Office Action—App 2020-502126.
Mar. 23, 2021 (JP) Office Action—App 2020-502126.
Apr. 19, 2021 (KR) Office Action—App App 10-2020-7000483.

* cited by examiner

SLAG DISCHARGING METHOD IN PROCESS OF PRODUCING ULTRA-LOW PHOSPHORUS STEEL AND METHOD FOR PRODUCING ULTRA-LOW PHOSPHORUS STEEL

CROSS-REFERENCE TO RELATED APPLICATIONS

The present application is a U.S. National Phase Application under 35 U.S.C. § 371 of PCT/CN2019/088064 filed May 23, 2019, which claims priority to Chinese application (CN) 2018114635554, filed Dec. 3, 2018, the contents therein of the applications is incorporated by reference herein in its entirety.

TECHNICAL FIELD

The present disclosure relates to the technical field of iron and steel smelting, and particularly to a slag discharging method in a process of producing ultra-low phosphorus steel and a method for producing ultra-low phosphorus steel.

BACKGROUND ART

Phosphorus is dissolved in ferrite in steel, and phosphorus is stably present in molten steel in the form of $Fe_2P$ and $Fe_3P$, which tend to segregate during crystallization. Phosphorus can significantly reduce the toughness of steel, especially tempering toughness and low temperature impact toughness, i.e., improve the cold brittleness of steel. Therefore, some types of steel have relatively high requirements on phosphorus content, e.g., a deep drawing steel, a casehardening steel for automobiles, an ultra-low carbon steel, a high-grade pipeline steel, etc.

There are generally three methods of dephosphorization: 1. dephosphorization by pretreating molten iron; 2. converter duplex dephosphorization; and 3. secondary dephosphorization of molten steel. The dephosphorization effects are generally as follows: 1. the dephosphorization level of dephosphorization by pretreating molten iron is 0.01-0.02%; 2. the dephosphorization level of converter duplex dephosphorization is less than 0.01%; and 3. the level of secondary dephosphorization of molten steel is less than 0.01%. The low phosphorus steel producing processes also generally include dephosphorization by pretreating molten iron, converter duplex dephosphorization, and secondary dephosphorization of molten steel. However, for the production processes in the prior art, the dephosphorization effects are generally poor, the phosphorus content in molten steel after dephosphorization is W(P)>0.005%, which can hardly achieve the effect of W(P)≤0.003%, and cannot reach the level required for dephosphorization of high-grade steels. In order to achieve high-grade dephosphorization of steel, it is necessary to add huge amount of equipment investment, increase iron consumption per ton of steel, or electricity consumption per ton of steel, and increase the production cost largely.

SUMMARY

The objects of the present disclosure include, for example, providing a slag discharging method in a process of producing ultra-low phosphorus steel, which is simple and convenient to operate, does not have high requirements for equipment, and has relatively good dephosphorization effect.

The objects of the present disclosure further include, for example, providing a method for producing ultra-low phosphorus steel, which has a low production cost, has good dephosphorization effect, and can high-efficiently produce an ultra-low phosphorus steel with W(P)≤0.003%.

The objects of the present disclosure further include, for example, providing an ultra-low phosphorus steel, the production of which employs the slag discharging method in a process of producing ultra-low phosphorus steel described in the present disclosure for slag discharging.

The present disclosure provides a slag discharging method in a process of producing ultra-low phosphorus steel, comprising:

adding lime along with molten steel, while pouring the molten steel into a steel ladle, so as to slag in advance and form basic slag;

blowing oxygen to the top of the steel ladle and blowing argon to the bottom of the steel ladle for converting;

tilting the steel ladle so that the surface of the molten steel is close to an opening of the steel ladle; and adding a carbon-containing reducing agent so that the basic slag is foamed and overflows from the opening of the steel ladle.

The present disclosure further provides a method for producing ultra-low phosphorus steel, comprising the above-described slag discharging method in a process of producing ultra-low phosphorus steel, and refining and ingotting after slag discharge.

The present disclosure further provides an ultra-low phosphorus steel, the production of which employs the slag discharging method in a process of producing ultra-low phosphorus steel of the present disclosure for slag discharging.

The advantageous effects are as follows:

The present disclosure provides a slag discharging method in a process of producing ultra-low phosphorus steel, in which molten steel is mixed with lime first to produce basic slag; then converting is performed with oxygen to increase the oxidizability of the basic slag; and a carbon-containing reducing agent is finally added, so that in the process that the carbon is oxidized to release a large amount of carbon monoxide gas, phosphates are captured, and the basic slag is rapidly foamed and overflows from the opening of the steel ladle, so that conditions are no longer available for rephosphorization. The slag discharging method is simple and convenient to operate, does not have high requirements on the equipment, has relatively good dephosphorization effect, and can be used to prepare an ultra-low phosphorus steel containing less than 0.003% phosphorus.

The present disclosure further provides a method for producing ultra-low phosphorus steel, which comprises the above-described slag discharging method in a process of producing ultra-low phosphorus steel, and refining and ingotting after slag discharge. The production method has good dephosphorization effect, has a low production cost, and can high-efficiently produce an ultra-low phosphorus steel containing less than 0.003% phosphorus.

DETAILED DESCRIPTION OF EMBODIMENTS

In order to make the objects, technical solutions and advantages of the embodiments of the present disclosure clearer, the technical solutions of the embodiments of the present disclosure will be described clearly and completely below. Examples are carried out in accordance with conventional conditions or conditions recommended by the manufacturer if no specific conditions are specified in the examples. Reagents or instruments used, whose manufacturers are not specified, are all conventional products that are available commercially.

Next, a slag discharging method in a process of producing ultra-low phosphorus steel and a method for producing ultra-low phosphorus steel according to the embodiments of the present disclosure will be specifically described.

An embodiment of the present disclosure provides a slag discharging method in process of producing ultra-low phosphorus steel, comprising:

S1. adding lime along with molten steel, while pouring the molten steel into a steel ladle, so as to slag in advance and form basic slag.

In the above, based on the mass of the molten steel, the addition amount of lime is 0.5-3 kg/t; and preferably, the addition amount of lime is 0.7-1 kg/t. The addition of lime can promote slagging in advance on the one hand, and can turn slag into basic slag on the other hand, to enhance the absorption for phosphorus.

In one or more embodiments, prior to pouring the molten steel in a converter or an intermediate frequency furnace into the steel ladle, the existing slag may be skimmed off or the slag may be stopped in the converter or the intermediate frequency furnace by a slag blocking method in order to remove the phosphorus-containing slag in advance to reduce the workload of subsequent slag discharge.

In one or more embodiments, the slag discharging method in a process of producing ultra-low phosphorus steel provided by the present disclosure further comprises:

S2. blowing oxygen to the top of the steel ladle and blowing argon to the bottom of the steel ladle for converting.

In order to facilitate the subsequent tilting operation, it is feasible to first lift the steel ladle to a steel ladle converting station with tilting function, and then perform a top oxygen blowing operation by using a self-consumption coated oxygen lance. In the above, the oxygen supply intensity for blowing oxygen to the top of the steel ladle is 50-300 NL/(min·t), and the pressure is 0.5-2.0 MPa. Preferably, the oxygen supply intensity is 100-150 NL/(min·t), and the pressure is 0.8-1.2 MPa. Blowing oxygen to the top of the steel ladle can change the environment of the molten steel into an oxidizing environment, so that phosphorus is oxidized and enters the basic slag to generate $4CaO*P_2O_5$ calcium phosphate salt.

The pressure for blowing argon to the bottom of the steel ladle is 0.3-0.8 MPa. Preferably, the pressure is 0.4-0.6 Mpa. Blowing argon to the bottom of the steel ladle can increase the stirring of the molten steel to cause phosphorus to be oxidized more rapidly and enter the basic slag.

Optionally, in the process of converting, the viscosity of the basic slag can be adjusted by adding fluorite, so that the basic slag can adsorb phosphorus better, which is more favorable for subsequent treatment. Preferably, based on the mass of the molten steel, the addition amount of fluorite is 0.5-3 kg/t; and preferably, the addition amount of fluorite is 1-1.5 kg/t. Preferably, the addition of fluorite is carried out 2 min after the starting of the oxygen blowing and argon blowing, at which time phosphorus has already begun to oxidize and combine with the basic slag, making the effect of the addition of fluorite better.

In one or more embodiments, the converting is carried out for a duration of 10-30 min, and after the converting, the FeO content in the basic slag is 10%-30%; and preferably, the converting is carried out for a duration of 15-20 min, and after the converting, the FeO content in the basic slag is 15%-20%. When the FeO content in the basic slag is within the above ranges, the prerequisite for oxidation dephosphorization is reached, and the next slag removal operation can be carried out.

In one or more embodiments, the slag discharging method in a process of producing ultra-low phosphorus steel provided by an embodiment of the present disclosure further comprises:

S3. tilting the steel ladle so that the surface of the molten steel is close to an opening of the steel ladle.

S4. adding a carbon-containing reducing agent so that the basic slag is foamed and overflows from the opening of the steel ladle.

Tilting the steel ladle is to facilitate the smooth discharge of the foamed basic slag in a later stage, and form an appropriate distance between the surface of the molten steel and the opening of the steel ladle, as an excessively large distance will result in incomplete discharge of the basic slag and residue of the basic slag, and an excessively small distance between the surface of the molten steel and the opening of the steel ladle will result in a loss in the molten steel in the slag discharging process and affect the output. Preferably, the steel ladle is tilted so that the surface of the molten steel is lower than the opening of the steel ladle by 50-200 mm; and more preferably, the surface of the molten steel is lower than the opening of the steel ladle by 80-120 mm.

In addition, the tilt angle of the steel ladle is 10-35 degrees; and preferably, the tilt angle of the steel ladle is 20-30 degrees. The steel ladle is tilted towards the opening of the steel ladle, resulting in that when foam slag is produced violently, the slag will only overflow from the opening of the steel ladle, and will not overflow everywhere without control. It should be noted that the tilt angle of the steel ladle should not be too large, so as to avoid accidents caused by overflow of the molten steel.

In one or more embodiments, the carbon-containing reducing agent comprises at least one of calcium carbide and a carburant. When calcium carbide is selected as the carbon-containing reducing agent, the particle size of calcium carbide is 5-20 mm, and based on the mass of the molten steel, the addition amount of calcium carbide is 0.3-0.7 kg/t; and preferably, the addition amount of calcium carbide is 0.5-0.6 kg/t. When a carburant is selected as the carbon-containing reducing agent, the particle size of the carburant is 0.5-1 mm, and based on the mass of the molten steel, the addition amount of the carburant is 0.2-0.5 kg/t; and preferably, the carburant is activated carbon, and the addition amount of activated carbon is 0.3-0.4 kg/t. The carbon-containing reducing agent can react with FeO in the basic slag, and produce abundant CO gas microbubbles instantaneously, which cause the slag to undergo a violent foaming reaction instantaneously, and quickly overflow from the opening of the steel ladle directionally, thus achieving the object of discharging the slag. Moreover, the steam of low melting point metals, such as zinc, lead and tin, which are harmful to steel, is easily carried out by the CO gas, which purifies the molten steel and remarkably improves the strength and toughness of high-grade steels. In addition, CO is further oxidized into $CO_2$ after exiting the liquid surface, thereby avoiding air pollution and personal injuries to the operator.

In one or more embodiments, the present disclosure further provides a method for producing ultra-low phosphorus steel, comprising the above-described slag discharging method in a process of producing ultra-low phosphorus steel, and refining and ingotting after slag discharge.

After slag discharge is completed, the steel ladle is restored from the tilted state, aluminum is added to the molten steel, argon blowing and stirring are carried out for 2-4 min to complete deoxidation refining, and after refining, the molten steel can be casted into steel ingots or continuous casting billets. Preferably, the addition amount of aluminum is 0.2-0.4 kg/t.

In one or more embodiments, the present disclosure further provides an ultra-low phosphorus steel, the production of which employs the above-described slag discharging method in a process of producing ultra-low phosphorus steel for slag discharging.

In one or more embodiments, the ultra-low phosphorus steel has a phosphorus content of less than 0.003%.

The features and properties of the present disclosure are described in further detail below in connection with the examples.

Example 1

This example provides a method for producing ultra-low phosphorus steel, the specific preparation steps of which are as follows:

S1. pouring molten steel smelted in a converter or an intermediate frequency furnace into a steel ladle after skimming the slag off, adding 0.8 kg/t of lime along with the steel flow, while pouring the molten steel into the steel ladle, so as to slag in advance and form basic slag.

S2. lifting the steel ladle to a steel ladle converting station with lifting function, and performing a top oxygen blowing operation by using a self-consumption coated oxygen lance, with an oxygen supply intensity of 120 NL/(min·t) and a pressure of 0.9 MPa; and at the same time, blowing argon to the bottom of the steel ladle and stirring, with an argon pressure of 0.45 MPa.

S3. after blowing oxygen and blowing argon for 2 min, adding 1.2 kg/t fluorite balls at one time as a slagging agent to adjust the slag viscosity, the overall converting time being controlled at 18 min, with the optimum FeO content in the steel ladle top slag being 18%.

S4. lifting the steel ladle, with an lifting angle of 20° based on the steel loading amount, so that the surface of the molten steel is lower than the opening of the steel ladle by 100 mm, adjusting the argon pressure to 0.5 MPa and the oxygen quantity to 130 NL/(min·t), and increasing the stirring strength for steel slag.

S5. adding CaC to the steel ladle in an amount of 0.56 kg/t, so that CaC and FeO react rapidly to produce abundant CO gas microbubbles instantaneously, which cause the slag to undergo a violent foaming reaction instantaneously, and quickly overflow from the opening of the steel ladle directionally, achieving a slag discharge rate of more than 95%.

S6. after phosphorus is discharged, stopping blowing oxygen to the top of the steel ladle, making the steel ladle from the tilted state return to the original state, then adding 0.3 kg/t of aluminum particles to the molten steel, and continuing blowing argon for 3 min to complete deoxidation refining.

S7. after the completion of refining, casting the molten steel into steel ingots or continuous casting billets.

The steel ingots or continuous casting billets prepared in this example were demonstrated, by testing, to have a phosphorus content of 0.0015%-0.0018%.

Example 2

This example provides a method for producing ultra-low phosphorus steel, the specific preparation steps of which are as follows:

S1. pouring molten steel smelted in a converter or an intermediate frequency furnace into a steel ladle after skimming the slag off, adding 1.0 kg/t of lime along with the steel flow, while pouring the molten steel into the steel ladle, so as to slag in advance and form basic slag.

S2. lifting the steel ladle to a steel ladle converting station with tilting function, and performing a top oxygen blowing operation by using a self-consumption coated oxygen lance, with an oxygen supply intensity of 140 NL/(min·t) and a pressure of 1.1 MPa, and introducing argon to the bottom of the steel ladle to perform argon blowing operation, with an argon pressure of 0.5 MPa.

S3. after blowing oxygen and blowing argon for 3 min, adding 1.4 kg/t fluorite balls at one time as a slagging agent to adjust the slag viscosity, the overall converting time being controlled at 20 min, with the optimum FeO content in the steel ladle top slag being 20%.

S4. tilting the steel ladle, with an tilting angle of 25° based on the steel loading amount, so that the surface of the molten steel is lower than the opening of the steel ladle by 120 mm.

S5. adding 0.4 kg/t of activated carbon to the steel ladle to produce abundant CO gas microbubbles instantaneously, which cause the slag to undergo a violent foaming reaction instantaneously, and quickly overflow from the opening of the steel ladle directionally, achieving a slag discharge rate of more than 95%.

S6. after phosphorus is discharged, stopping blowing oxygen to the top of the steel ladle, making the steel ladle from the tilted state return to the original state, then adding 0.3 kg/t of aluminum particles to the molten steel, and continuing blowing argon for 2.5 min to complete deoxidation refining.

S7. after the completion of refining, casting the molten steel into steel ingots or continuous casting billets.

The steel ingots or continuous casting billets prepared in this example were demonstrated, by testing, to have a phosphorus content of 0.0017%-0.0020%.

Example 3

This example provides a method for producing ultra-low phosphorus steel, the specific preparation steps of which are as follows:

S1. pouring molten steel smelted in a converter or an intermediate frequency furnace into a steel ladle after skimming the slag off, adding 3.0 kg/t of lime along with the steel flow, while pouring the molten steel into the steel ladle, so as to slag in advance and form basic slag.

S2. lifting the steel ladle to a steel ladle converting station with tilting function, and performing a top oxygen blowing operation by using a self-consumption coated oxygen lance, with an oxygen supply intensity of 300 NL/(min·t) and a pressure of 2.0 MPa, and introducing argon to the bottom of the steel ladle to perform argon blowing operation, with an argon pressure of 0.8 MPa.

S3. after blowing oxygen and blowing argon for 3 min, adding 0.5 kg/t fluorite balls at one time as a slagging agent to adjust the slag viscosity, the overall converting time being controlled at 30 min, with the optimum FeO content in the steel ladle top slag being 28%.

S4. tilting the steel ladle, with an tilting angle of 10° based on the steel loading amount, so that the surface of the molten steel is lower than the opening of the steel ladle by 200 mm.

S5. adding 0.7 kg/t of activated carbon to the steel ladle to produce abundant CO gas microbubbles instantaneously, which cause the slag to undergo a violent foaming reaction instantaneously, and quickly overflow from the opening of the steel ladle directionally, achieving a slag discharge rate of more than 95%.

S6. after phosphorus is discharged, stopping blowing oxygen to the top of the steel ladle, making the steel ladle from the tilted state return to the original state, then adding 0.4 kg/t of aluminum particles to the molten steel, and continuing blowing argon for 4 min to complete deoxidation refining.

S7. after the completion of refining, casting the molten steel into steel ingots or continuous casting billets.

The steel ingots or continuous casting billets prepared in this example were demonstrated, by testing, to have a phosphorus content of 0.0023%-0.0026%.

Example 4

This example provides a method for producing ultra-low phosphorus steel, the specific preparation steps of which are as follows:

S1. pouring molten steel smelted in a converter or an intermediate frequency furnace into a steel ladle after skimming the slag off, adding 0.5 kg/t of lime along with the steel flow, while pouring the molten steel into the steel ladle, so as to slag in advance and form basic slag.

S2. lifting the steel ladle to a steel ladle converting station with tilting function, and performing a top oxygen blowing operation by using a self-consumption coated oxygen lance, with an oxygen supply intensity of 50 NL/(min·t) and a pressure of 0.5 MPa, and introducing argon to the bottom of the steel ladle to perform argon blowing operation, with an argon pressure of 0.3 MPa.

S3. after blowing oxygen and blowing argon for 3 min, adding 3 kg/t fluorite balls at one time as a slagging agent to adjust the slag viscosity, the overall converting time being controlled at 10 min, with the optimum FeO content in the steel ladle top slag being 12%.

S4. tilting the steel ladle, with an tilting angle of 35° based on the steel loading amount, so that the surface of the molten steel is lower than the opening of the steel ladle by 50 mm.

S5. adding 0.3 kg/t of activated carbon to the steel ladle to produce abundant CO gas microbubbles instantaneously, which cause the slag to undergo a violent foaming reaction instantaneously, and quickly overflow from the opening of the steel ladle directionally, achieving a slag discharge rate of more than 95%.

S6. after phosphorus is discharged, stopping blowing oxygen to the top of the steel ladle, making the steel ladle from the tilted state return to the original state, then adding 0.2 kg/t of aluminum particles to the molten steel, and continuing blowing argon for 2 min to complete deoxidation refining.

S7. after the completion of refining, casting the molten steel into steel ingots or continuous casting billets.

The steel ingots or continuous casting billets prepared in this example were demonstrated, by testing, to have a phosphorus content of 0.0025%-0.0028%.

To sum up, the present disclosure provides a slag discharging method in a process of producing ultra-low phosphorus steel, in which molten steel is mixed with lime first to produce basic slag; then converting is performed with oxygen to increase the oxidizability of the basic slag; and a carbon-containing reducing agent is finally added, so that in the process that the carbon is oxidized to release a large amount of carbon monoxide gas, phosphates are captured, and the basic slag is rapidly foamed and overflows from the opening of the steel ladle, so that conditions are no longer available for rephosphorization. The slag discharging method is simple and convenient to operate, does not have high requirements on the equipment, has relatively good dephosphorization effect, and can be used to prepare an ultra-low phosphorus steel containing less than 0.003% phosphorus.

The present disclosure further provides a method for producing ultra-low phosphorus steel, which comprises the above-described slag discharging method in a process of producing ultra-low phosphorus steel, and refining and ingotting after slag discharge. The production method has good dephosphorization effect, has a low production cost, and can high-efficiently produce an ultra-low phosphorus steel containing less than 0.003% phosphorus.

The above description is merely illustrative of preferred embodiments of the present disclosure and is not intended to limit the present disclosure. For a person skilled in the art, various modifications and variations can be made to the present disclosure. Any modifications, equivalent substitutions, improvements and so on made within the spirit and principle of the present disclosure are to be included in the scope of protection of the present disclosure.

INDUSTRIAL APPLICABILITY

The present disclosure provides a slag discharging method in a process of producing ultra-low phosphorus steel, in which molten steel is mixed with lime first to produce basic slag; then converting is performed with oxygen to increase the oxidizability of the basic slag; and a carbon-containing reducing agent is finally added, so that in the process that the carbon is oxidized to release a large amount of carbon monoxide gas, phosphates are captured, and the basic slag is rapidly foamed and overflows from the opening of the steel ladle, so that conditions are no longer available for rephosphorization. The slag discharging method is simple and convenient to operate, does not have high requirements on the equipment, has relatively good dephosphorization effect, and can be used to prepare an ultra-low phosphorus steel containing less than 0.003% phosphorus.

The invention claimed is:

1. A slag discharging method in a process of producing ultra-low phosphorus steel, comprising:

adding lime along with molten steel, while pouring the molten steel into a steel ladle, so as to slag in advance and form basic slag;

blowing oxygen to a top of the steel ladle and blowing argon to a bottom of the steel ladle for converting;

tilting the steel ladle so that a surface of the molten steel is close to an opening of the steel ladle; and adding a carbon-containing reducing agent so that the basic slag is foamed and overflows from the opening of the steel ladle, wherein an oxygen supply intensity for blowing oxygen to the top of the steel ladle is 50-300 NL/(min·t), and a pressure is 0.5-2.0 MPa.

2. The slag discharging method according to claim 1, wherein based on a mass of the molten steel, an addition amount of the lime is 0.5-3 kg/t.

3. The slag discharging method according to claim 1, wherein an oxygen supply intensity for blowing oxygen to the top of the steel ladle is 100-150 NL/(min·t), and a pressure is 0.8-1.2 MPa.

4. The slag discharging method according to claim 1, wherein a pressure for blowing argon to the bottom of the steel ladle is 0.3-0.8 MPa.

5. The slag discharging method according to claim 1, wherein in a process of the converting, fluorite is added to adjust a viscosity of the basic slag.

6. The slag discharging method according to claim 5, wherein based on the mass of the molten steel, an addition amount of the fluorite is 0.5-3 kg/t.

7. The slag discharging method according to claim 1, wherein the converting is carried out for a duration of 10-30 min, and after the converting, a FeO content in the basic slag is 10%-30%.

8. The slag discharging method according to claim 7, wherein the converting is carried out for a duration of 15-20 min, and after the converting, the FeO content in the basic slag is 15%-20%.

9. The slag discharging method according to claim 1, wherein the steel ladle is tilted so that the surface of the molten steel is lower than the opening of the steel ladle by 50-200 mm.

10. The slag discharging method according to claim 1, wherein a tilt angle of the steel ladle is 10-35 degrees.

11. The slag discharging method according to claims 1, wherein the carbon-containing reducing agent comprises at least one of calcium carbide and a carburant.

12. The slag discharging method according to claim 11, wherein the carbon-containing reducing agent contains the calcium carbide, wherein a particle size of the calcium carbide is 5-20 mm, and based on the mass of the molten steel, an addition amount of the calcium carbide is 0.3-0.7 kg/t.

13. The slag discharging method according to claim 11, wherein the carbon-containing reducing agent contains the carburant, wherein a particle size of the carburant is 0.5-1 mm, and based on the mass of the molten steel, an addition amount of the carburant is 0.2-0.5 kg/t.

14. The slag discharging method according to claim 13, wherein the carburant is activated carbon, and an addition amount of the activated carbon is 0.3-0.4 kg/t.

15. A method for producing ultra-low phosphorus steel, comprising the slag discharging method in a process of producing ultra-low phosphorus steel according to claim 1, and refining and ingotting after slag discharge.

16. The method according to claim 15, wherein the refining comprises making, after completing the slag discharge, the steel ladle return from a tilted state to an original state, adding aluminum to the molten steel, and keeping argon blowing and stirring for 2-4 min to complete deoxidation refining.

17. The method according to claim 15, wherein the ingotting comprises casting, after completing the refining, the molten steel into steel ingots or continuous casting billets.

18. The method according to claim 17, wherein an addition amount of the aluminum is 0.2-0.4 kg/t.

* * * * *